US006073399A

United States Patent [19]

Shipman et al.

[11] Patent Number: 6,073,399

[45] Date of Patent: Jun. 13, 2000

[54] POST AND BEAM SUPPORTED SLATWALL

[75] Inventors: David A. Shipman, Grand Rapids; Paul D. Hurley, Holland, both of Mich.; Robert C. Coon, Chicago, Ill.

[73] Assignee: Steelcase Development Inc., Grand Rapids, Mich.

[21] Appl. No.: 09/014,671

[22] Filed: Jan. 28, 1998

[51] Int. Cl.[7] ..... E04B 2/00

[52] U.S. Cl. ..... 52/36.1; 52/36.6; 52/238.1; 52/243.1; 52/220.7; 52/239; 40/607

[58] Field of Search ..... 52/36.5, 36.6, 52/36.1, 239, 220.7, 736.2, 238.1, 243.1; 40/607, 757, 617; 248/297.21

[56] References Cited

U.S. PATENT DOCUMENTS

| | | | |
|---|---|---|---|
| 1,917,917 | 7/1933 | Bales . | |
| 3,194,362 | 7/1965 | Wargo | 52/239 |
| 3,517,467 | 6/1970 | Propst et al. . | |
| 3,614,044 | 10/1971 | Bard . | |
| 4,541,599 | 9/1985 | Schoumaker . | |
| 4,550,893 | 11/1985 | Wiersema et al. . | |
| 4,936,534 | 6/1990 | Cattaneo . | |
| 5,228,579 | 7/1993 | Kaufman | 52/36 |
| 5,230,492 | 7/1993 | Zwart et al. . | |
| 5,277,393 | 1/1994 | Nicholson et al. . | |
| 5,309,686 | 5/1994 | Underwood et al. | 52/29 |
| 5,394,658 | 3/1995 | Schreiner et al. | 52/36.1 |
| 5,511,348 | 4/1996 | Cornell et al. . | |
| 5,933,992 | 8/1999 | Padiak et al. | 40/607 |

*Primary Examiner*—Richard Chilcot
*Attorney, Agent, or Firm*—Price, Heneveld, Cooper, DeWitt & Litton

[57] ABSTRACT

A combination overhead support system and accessory board includes at least one freestanding post disposed in a substantially vertical position. The post includes at least one longitudinally-extending connector portion. At least one beam is supported at least in part by the post in a substantially horizontal, overhead position. An accessory board having at least one side face configured to removably support articles thereon and opposite first and second marginal side edges is normally disposed in a generally vertical orientation. The first side is detachably connected to the connector portion of the post to support the accessory board on the post in a cantilevered fashion. The second side edge is substantially free, and unsupported by the overhead support system.

36 Claims, 7 Drawing Sheets

POST AND BEAM SUPPORTED SLATWALL

CROSS-REFERENCE

The present application is related to commonly assigned U.S. Pat. No. 5,899,025, issued on May 4, 1999, entitled FURNITURE SYSTEMS, and commonly assigned U.S. Pat. No. 5,950,371, issued on Sep. 14, 1999, entitled COLUMN MOUNTABLE SHELF FOR FURNITURE SYSTEMS, each of which are hereby incorporated by reference.

BACKGROUND OF THE INVENTION

The present invention relates to a slat wall that is supported by a post and beam.

Modern offices are becoming increasingly complicated and sophisticated due largely to the ever-increasing needs of the users for improved utilities support at each work station. One important consequence of the advent of sophisticated electronic offices is the increased need and desirability for distributing utilities throughout the various offices in a manner which can be readily reconfigured. The term "utilities" as used herein incorporates a wide variety of facilities for use at a work station, including security devices, electrical power, signal and/or communications, HVAC, water and other fluids, and other similar resources. Open office plans have been developed to reduce overall office space and costs, and generally incorporate large, open floor spaces in buildings that are equipped with modular furniture systems which are readily reconfigurable to accommodate the ever-changing needs of a specific user, as well as the divergent requirements of several tenants. One arrangement, used for furnishing open plans, includes movable partition panels that are detachably interconnected to partition off the open spaces into individual work stations and/or offices.

Slat walls having a plurality of horizontally extending grooves that are configured to removably support file hangers, clipboards, book shelves and the like may be utilized to facilitate efficient use of available space in various types of office settings. However, such slat walls may be permanently attached to a partition panel, hindering reconfiguration of the panel system. Further, such slat walls are only configured to be used with partition panel systems that may have limited utility distribution capability, and often do not facilitate optimal use of available floor space. Overhead support systems including posts and overhead beams have not heretofore included provisions for removably supporting an easily reconfigurable slat wall to facilitate the efficient use of floor space.

SUMMARY OF THE INVENTION

One aspect of the present invention is to provide a combination overhead support system and accessory board. The combination overhead support system and accessory board includes at least one freestanding post disposed in a substantially vertical position. The post includes at least one longitudinally-extending connector portion. At least one beam is supported at least in part by the post in a substantially horizontal, overhead position. An accessory board having at least one side face configured to removably support articles thereon and opposite first and second marginal side edges is normally disposed in a generally vertical orientation. The first side is detachably connected to the connector portion of the post to support the accessory board on the post in a cantilevered fashion. The second side edge is substantially free, and unsupported by the overhead support system.

Another aspect of the present invention is a combination overhead support system and accessory board that includes at least one freestanding post disposed in a substantially vertical position, and at least one beam supported at least in part by the post in a substantially horizontal, overhead position. An accessory board has opposite first and second marginal side edges normally disposed in a generally vertical orientation. The first side edge of the accessory board is connected to the post to support the accessory board on the post in a cantilevered fashion. A bumper is connected with the accessory board and engages a portion of the beam to selectively retain the accessory board in a predetermined position.

Yet another aspect of the present invention is a combination overhead support and accessory system for workstations and the like, including at least one freestanding post disposed in a substantially vertical position, and at least one beam supported at least in part by the post in a substantially horizontal, overhead position. A slatwall accessory board is supported solely on the overhead support system and has at least one side thereof with a plurality of horizontally-extending channels spaced vertically apart along the side face. At least one accessory unit is configured to personalize an associated workstation and includes a connector shaped for reception in the channels to detachably support the accessory unit at a plurality of locations on the slatwall face.

These and other advantages of the invention will be further understood and appreciated by those skilled in the art by reference to the following written specification, claims and appended drawings.

DETAILED DESCRIPTION OF PREFERRED EMBODIMENT

Figure 1:
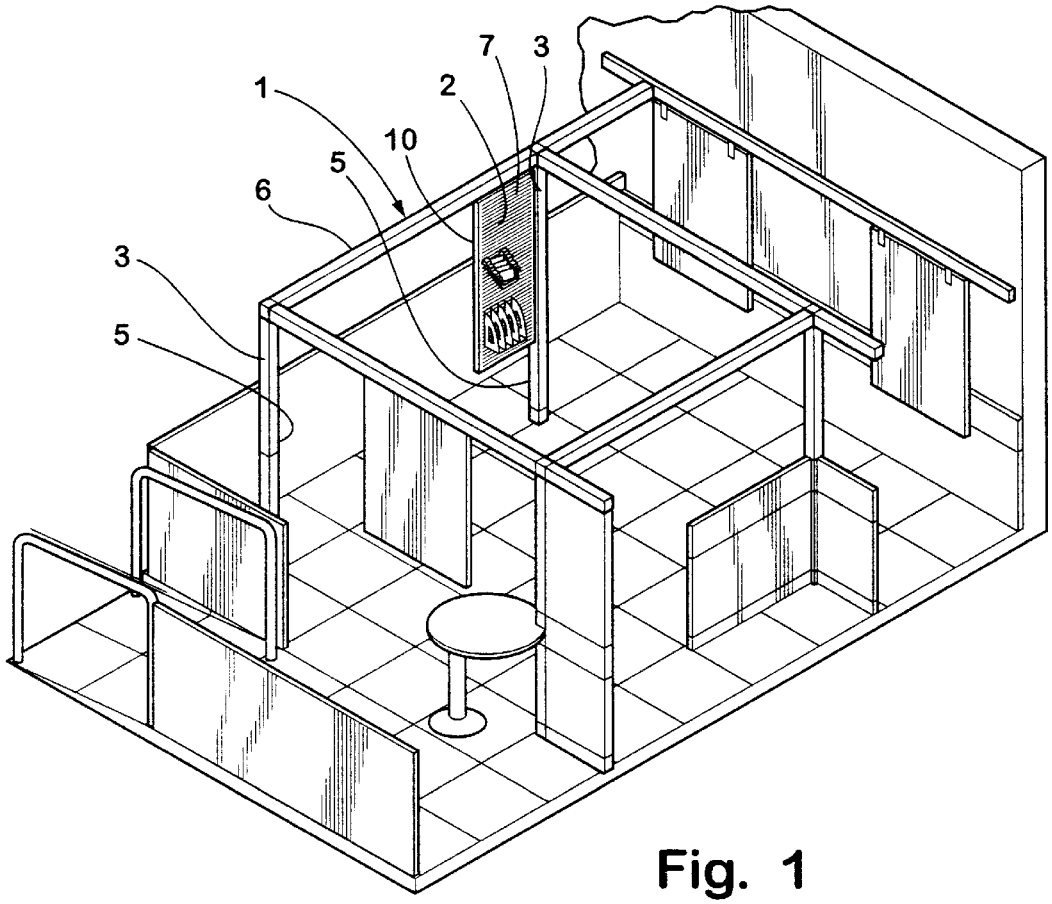
FIG. 1 is fragmentary, perspective view of a post and beam supported slat wall embodying the present invention.
Figure 2:
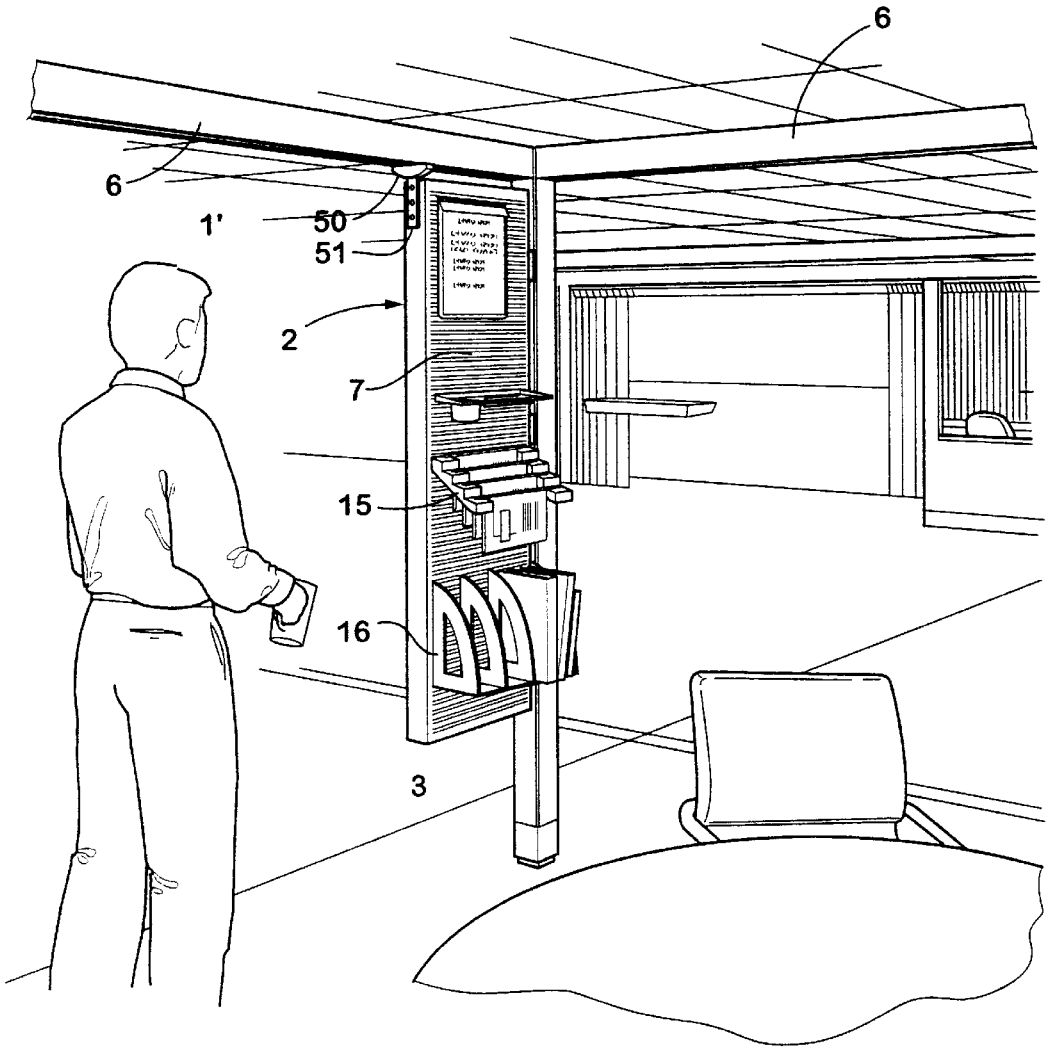
FIG. 2 is fragmentary, perspective view of a post and beam supported slat wall embodying the present invention.

For purposes of description herein, the terms "upper," "lower," "right," "left," "rear," "front," "vertical," "horizontal" and derivatives thereof shall relate to the invention as oriented in FIGS. 1 and 2. However, it needs to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the independent claims. Hence, specific dimensions and other physical characteristics relating to the embodiments disclosed herein are not to be considered as limiting, unless the claims expressly state otherwise.

Figure 5:
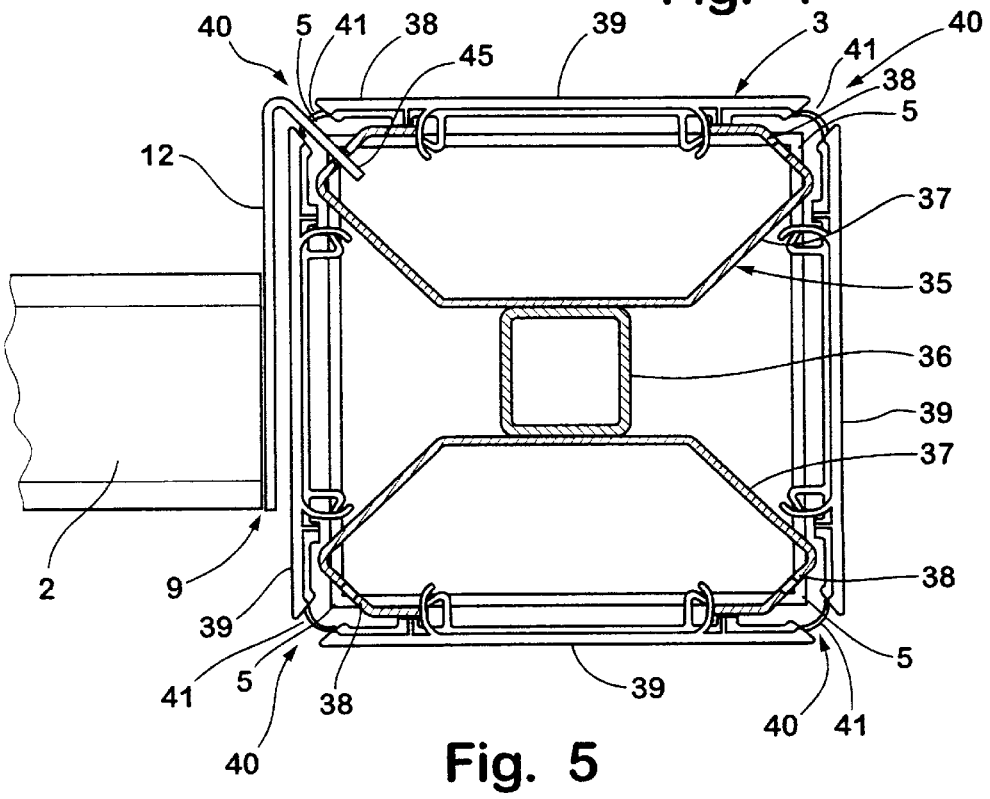
FIG. 5 is a cross-sectional view of the post of FIG. 1.

With reference to FIGS. 1 and 2, a combination overhead support system 1 and accessory board 2 includes at least one freestanding post 3 disposed in a substantially vertical position. The post 3 includes at least one longitudinally-extending connector portion such as a vertical row of slots 5 (FIG. 5). At least one beam 6 (FIGS. 1 and 2) is supported at least in part by the post 3 in a substantially horizontal, overhead position. An accessory board 2 has at least one side face 7 configured to removably support articles such as file hanger 15 or bookshelf 16 thereon. The accessory board 2 includes opposite first and second marginal side edges 9, 10 normally disposed in a generally vertical orientation. The first side edge 9 is detachably connected to the connector portion or slots 5 of the post 3, such as by upper and lower hooked brackets 12, 13 to support the accessory board 2 on the post 3 in a cantilevered fashion. The second side edge 10 is substantially free, and unsupported by the overhead support system 1.

Figure 3:
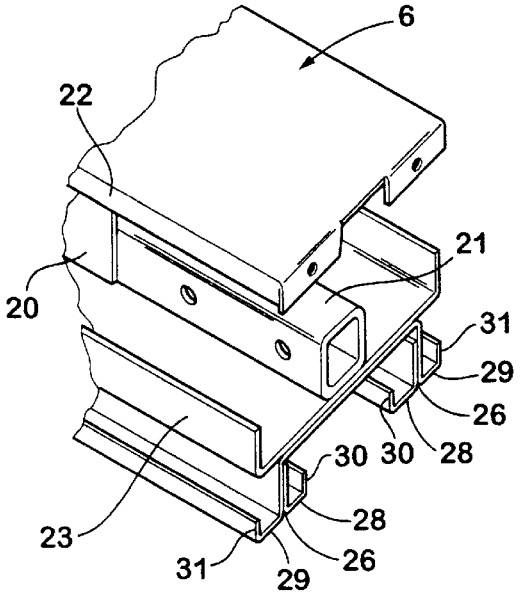
FIG. 3 is a fragmentary, perspective view of an end portion of the beam of FIG. 1.
Figure 4:
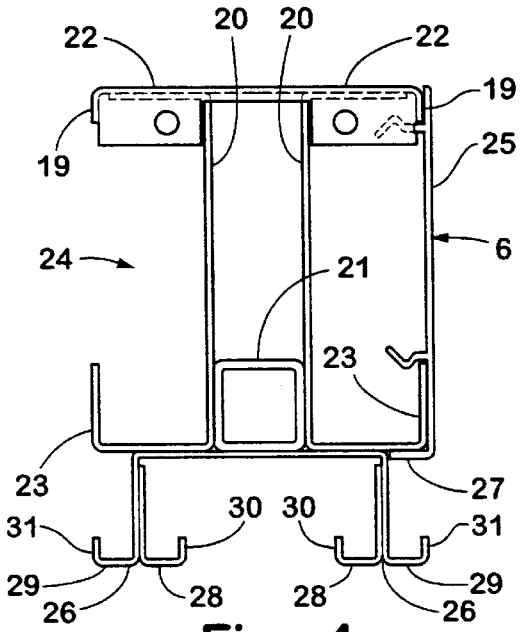
FIG. 4 is an end view of the beam of FIG. 1.

With reference to FIGS. 3 and 4, the beam 6 is formed from sheet metal, and has a pair of generally parallel, vertically-oriented webs 20 with a tube 21 having a generally quadrilateral cross-sectional shape therebetween. Upper flange 22 extends sidewardly and forms downwardly extending side flanges 19. Opposing lower side flanges 23 extend sidewardly and upwardly to define therebetween an opening 24 which may be closed off by a cover 25 which is removably supported on side flanges 19 and 23. A pair of inverted T-shaped sections 26 extend along a bottom side 27 of the beam 6. Each inverted T-shaped section 26 includes an inner horizontal leg 28 and an outer horizontal leg 29 that terminate at inner and outer upwardly extending vertical portions 30 and 31, respectively.

With reference to FIG. 5, the post 3 has a generally quadrilateral cross-sectional shape and includes an elongated vertically extending center structure 35 that has a generally X-shaped cross section. Four covers 39 are releasably connected to the center structure 35, and extend vertically, thereby defining a generally quadrilateral cross-sectional shape with corners 40. A tube 36 extends upwardly through the center of the post 3. A pair of channels 37 are fixed to opposite sides of the tube 36, as by welding. Each channel 37 has an outer flange 38 that includes a vertical row of slots 5 for removably supporting hang-on items such as the accessory board 2. Each cover 39 is spaced-apart from each adjacent cover to define a vertically extending gap 41 therebetween that allows access to the vertical row of slots 5. The upper hooked bracket 12 is connected to the first vertical side edge 9 of the accessory board 2. The hooked portion 45 of upper and lower brackets 12 and 13 extends inwardly at a 45° angle and removably engages the vertical row of slots 5 for support of the accessory board 2. The 45° angle of the hooked portion 45 provides proper orientation of the accessory board 2 along the lower edge of beam 6.

Figure 6:
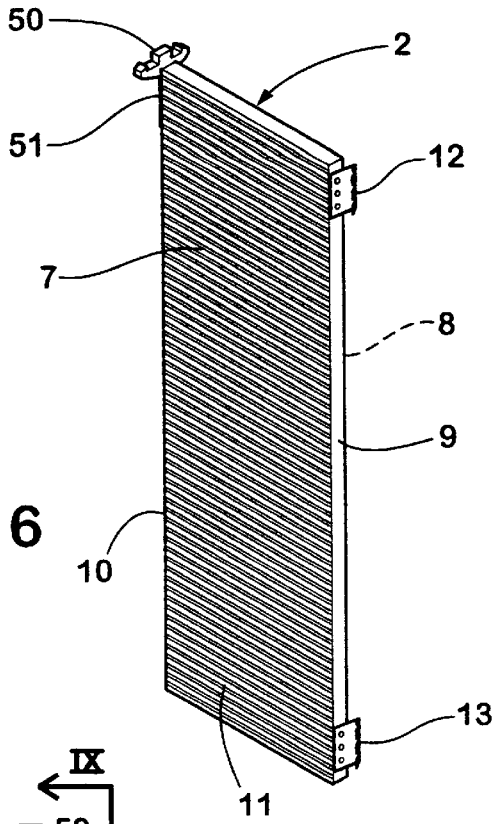
FIG. 6 is a perspective view of the accessory board of FIG. 1.

With reference to FIG. 6, the accessory board 2 includes a bumper 50 that is attached to the accessory board 2 by bumper bracket 51. As described in more detail below, the bumper 50 is configured to engage the lower edge of a beam 6 to support the second side edge 10 and prevent rotation of the accessory board 2 about the side edge 9 at the attachment to the post 3.

Figure 8:
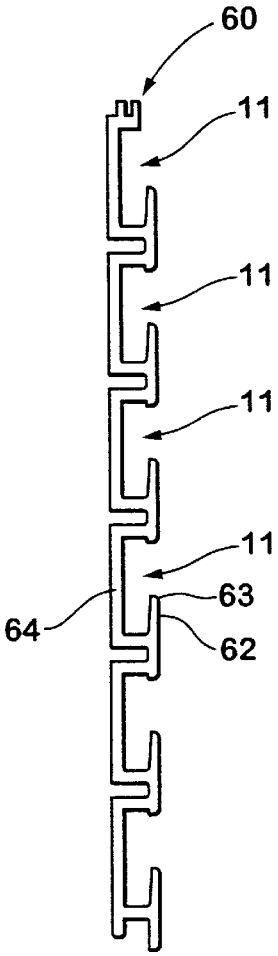
FIG. 8 is a side elevational view of the slat extrusion of FIG. 1.
Figure 10:
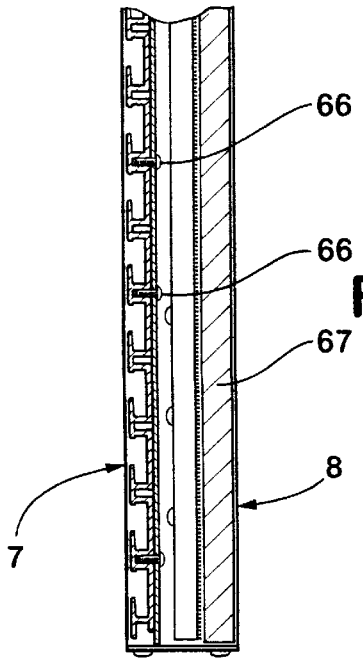
FIG. 10 is a sectional view of the bottom portion of the accessory board taken along the line X—X of FIG. 7.

With reference to FIG. 8, a slat extrusion 60 defines a plurality of horizontally extending slats 11. Each slat 11 is defined by a channel having a generally U-shaped lower portion with an outer leg 62 that terminates at an upper edge 63. The inner leg 64 of the U-shaped portion forms the back wall of the slat 11. Slat extrusion 60 is fastened to a substantially flat metal pan 65 by screws 66 (FIG. 10). The metal pan 65 is fastened to board 67 that forms the second side face 8 of the accessory board 2.

Figure 9:
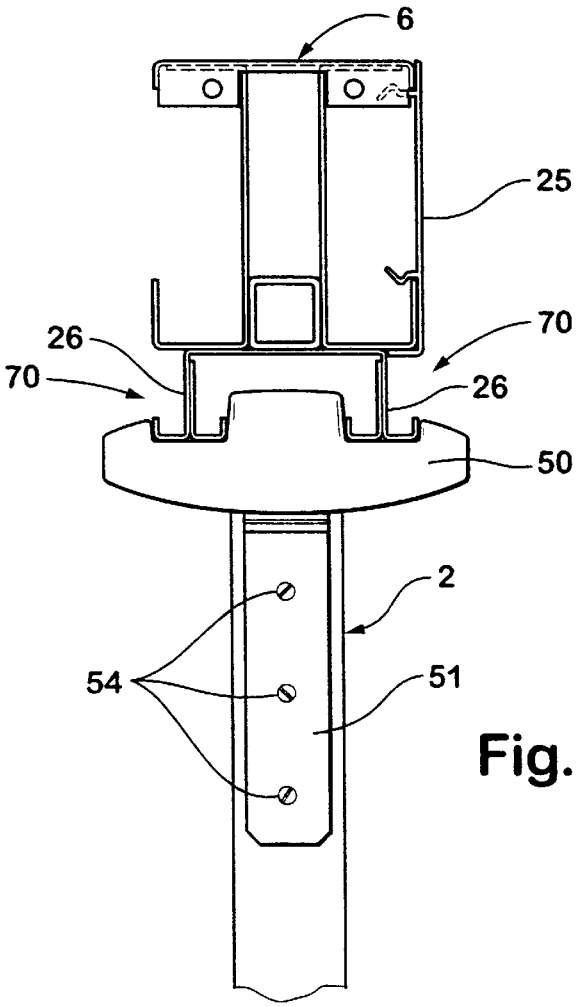
FIG. 9 is a sectional view of the top portion of the accessory board taken along the line IX—IX of FIG. 7 and including the beam of FIG. 4.
Figure 16:
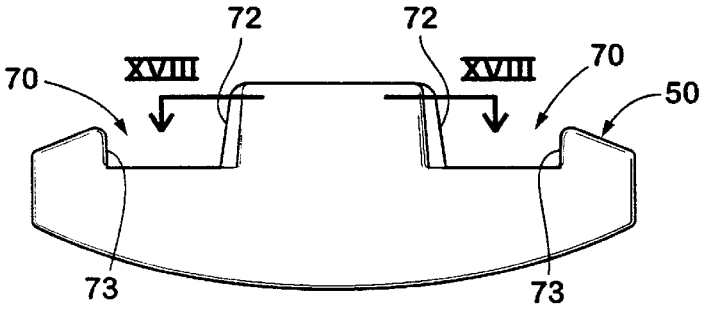
FIG. 16 is a side elevational view of the bumper.
Figure 17:
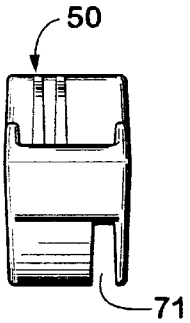
FIG. 17 is a side elevational view of the bumper.

With reference to FIG. 9, bumper 50 is made of a thermo-plastic rubber material and defines a pair of upwardly-opening U-shaped portions 70, each of which receives an inverted T-shaped portion 26 of a beam 6. A slot 71 (FIG. 17) extends along the lower side of the bumper 50, and provides clearance for the extensions 59 of the bumper bracket 51. Side edges 72, 73 (FIG. 16) are tapered slightly and are configured to snugly receive the inverted T-shaped portion 26 of the beam 6 to support the accessory board 2, thereby preventing rotation of the accessory board 2 about the first side edge 9 at the connection to the post 3.

Figure 7:
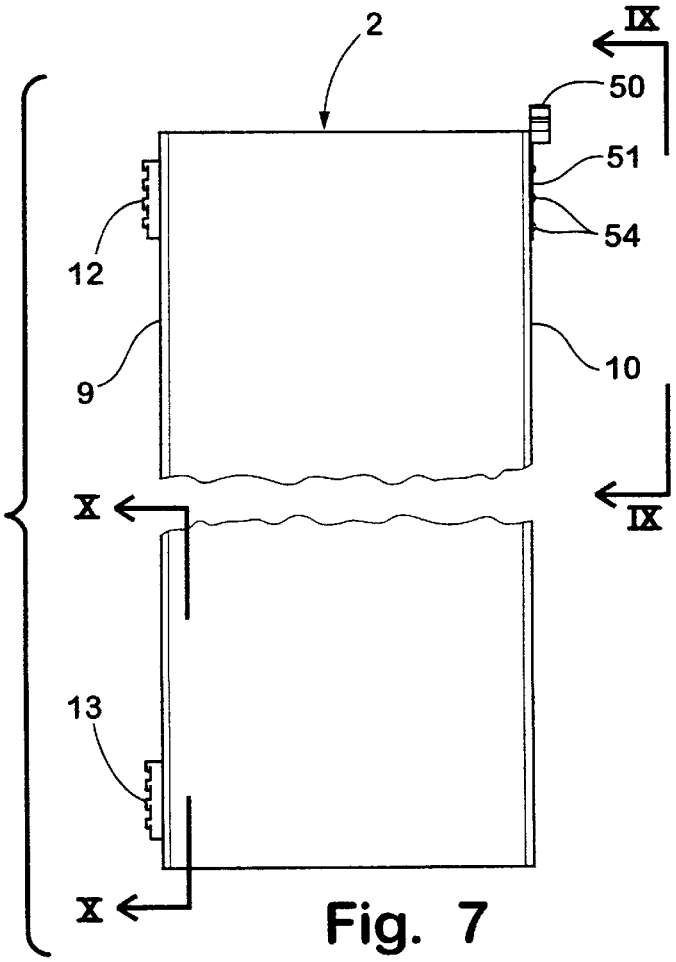
FIG. 7 is a fragmentary, front elevational view of the accessory board of FIG. 1.
Figure 11:
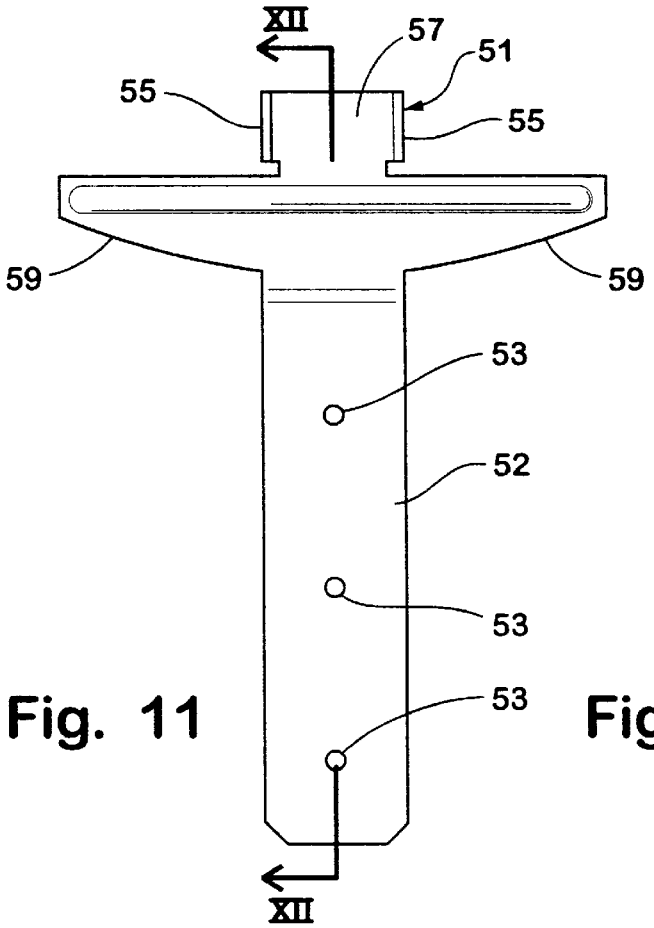
FIG. 11 is a front elevational view of the bumper mounting bracket of FIG. 6.
Figure 12:
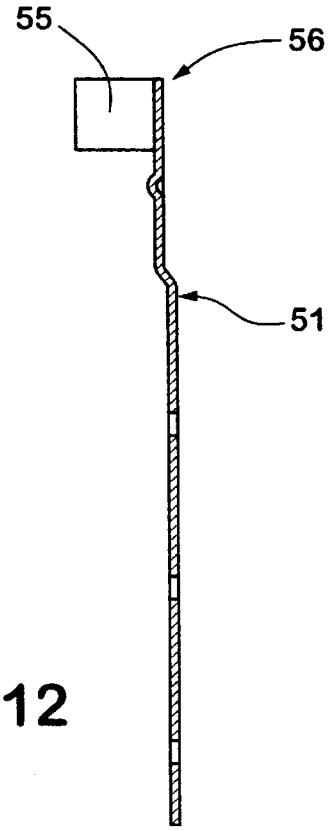
FIG. 12 is a cross-sectional view of the bumper mounting bracket of FIG. 6 taken along the line XII—XII of FIG. 12.
Figure 18:
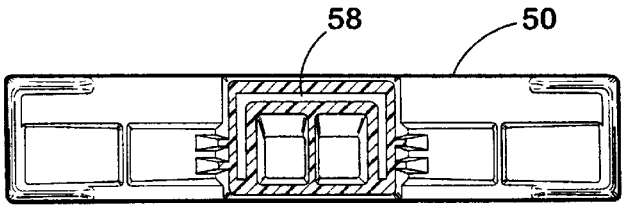
FIG. 18 is a cross-sectional view of the bumper taken along the line XVII—XVII of FIG. 16.

Bumper bracket 51 (FIGS. 11, 12) attaches bumper 50 to the accessory board 2. The lower flat portion 52 of the bumper bracket 51 includes a plurality of clearance holes 53 that receive screws 54 (FIGS. 7, 9) to connect the bumper bracket 51 to the accessory board 2. A web 57 extends upwardly forming the upper end 56 of bumper bracket 51. A pair of tabs 55 extend from the web 57. Tabs 55 and web 57 are closely received in the U-shaped opening 58 (FIG. 18) of the bumper 50.

Figure 13:
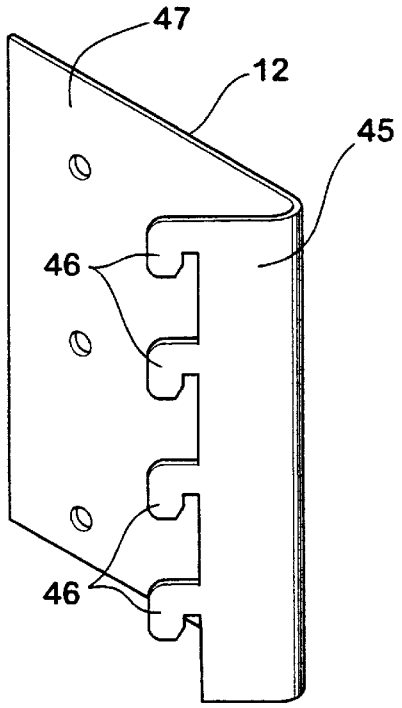
FIG. 13 is a perspective view of the hooked support bracket of FIG. 6.
Figure 14:
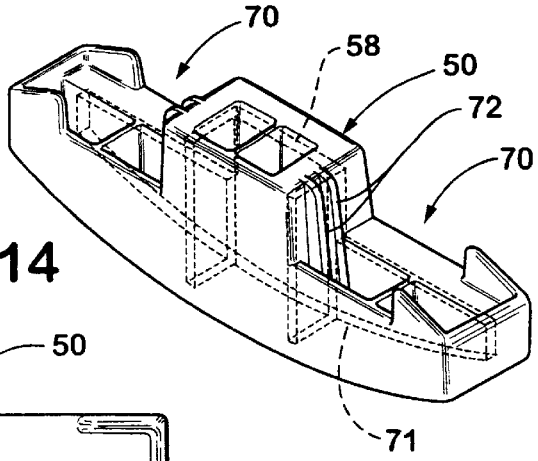
FIG. 14 is a perspective view of the bumper of FIG. 6.
Figure 15:
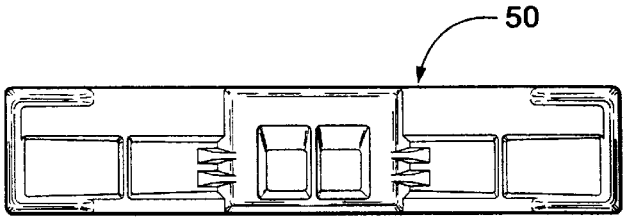
FIG. 15 is a top elevational view of the bumper.

With reference to FIG. 13, the upper hooked bracket 12 is formed from sheet metal and includes a plurality of hooks 46 extending from the hooked portion 45. The hooked portion 45 extends inwardly at a 45° angle relative to the base portion 47 of the upper bracket 12. Lower hooked bracket 13 is substantially the same as upper hooked bracket 12. The first and second vertical side edges 9, 10 of the accessory board 2 are substantially the same prior to attachment of the upper and lower hooked brackets 12, 13 and the bumper 50. The upper bracket 12 illustrated in FIG. 13 is a "right hand" bracket that is configured to be attached to the first vertical side edge 9. However, the upper and lower brackets 12 and 13 may be made with the hooked portion 45 extending from the base portion 47 in an opposite direction to form a "left hand" bracket that attaches to the second side edge 10 of the accessory board 2. Similarly, the bumper 50 may be attached to the first vertical side edge 9. This allows the accessory board 2 to be configured for attachment to a post along either the first vertical side edge 9, or the second vertical side edge 10, as required for a particular application.

During installation, the hooked brackets 12 and 13 connected to the vertical side edge 9. The hooks 46 are inserted into the vertical slots 5 of a post 3, and the accessory board 2 is moved downwardly to engage hooks 46 in slots 5. The bumper 50 is then placed on the bumper bracket 51 by inserting the web 57 and tabs 55 into the U-shaped opening 58 in the bumper 50. The upper edge of the accessory board 2 is then aligned with the lower edge of the beam 6, and the U-shaped portions 70 of the bumper 50 are brought into contact with the inverted T-shaped portions 26 of the beam 6. The bumper bracket 51 is then fastened to the side edge 10 of the accessory board 2 by means of screws 54. As discussed above, the upper and lower hooked brackets 12 and 13 may be either left-handed or right-handed to allow support of the accessory board 2 along either the first or second side edge 9 or 10, as required for a particular application.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A combination overhead support system and accessory board, wherein:

said overhead support system includes at least one freestanding post and at least one beam;

said at least one freestanding post disposed in a substantially vertical position, and including at least one longitudinally-extending connector portion;

said at least one beam supported at least in part by said at least one post in a substantially horizontal overhead position; and said accessory board having at least one side face configured to removably support articles thereon, and opposite first and second marginal side edges normally disposed in a generally vertical orientation, wherein said first side edge is detachably connected to said connector portion of said at least one post to support said accessory board on said at least one post in a cantilevered fashion, with said second side edge being substantially free, and said second side edge unsupported by said overhead support system.

2. A combination overhead support system and accessory board as set forth in claim 1, wherein:

said lower edge of said accessory board extends horizontally, parallel to said at least one beam.

3. A combination overhead support system and accessory board as set forth in claim 2, wherein:

said accessory board has an upper marginal edge normally disposed in a generally horizontal orientation a spaced-apart distance below said at least one beam, and includes a bumper which selectively engages said at least one beam to facilitate retaining said accessory board in a predetermined position.

4. A combination overhead support system and accessory board as set forth in claim 3, wherein:

said bumper is disposed adjacent said second side edge of said accessory board to provide improved stability.

5. A combination overhead support system and accessory board as set forth in claim 4, wherein:

said bumper includes an upwardly opening U-shaped portion in which an adjacent lower portion of said at least one beam is received to positively prevent rotation of said accessory board about said first side edge.

6. A combination overhead support system and accessory board as set forth in claim 5, wherein:

said bumper is detachably fastened to said second side edge of said accessory board adjacent an upper portion thereof.

7. A combination overhead support system and accessory board as set forth in claim 6, wherein:

said at least one post includes a plurality of regularly spaced, vertically oriented slots defining said connector portion; and said accessory board includes at least one laterally-extending hook shaped for close reception in a selected one of said slots to detachably mount said accessory board on said at least one post.

8. A combination overhead support system and accessory board as set forth in claim 7, wherein:

said accessory board includes a second laterally-extending hook, spaced vertically apart from said one hook on said first edge, and shaped for close reception in another one of said slots to securely, yet detachably support said accessory board on said at least one post in said cantilevered fashion.

9. A combination overhead support system and accessory board as set forth in claim 8, wherein:

said at least one post includes at least one longitudinally-extending corner edge; and said slots are disposed along said at least one longitudinally-extending corner edge of said at least one post.

10. A combination overhead support system and accessory board as set forth in claim 9, wherein:

said at least one post has a generally quadrilaterally-shaped horizontal cross-sectional configuration defining four side faces, and with said slots extending along each said corner edge thereof; and said first side edge of said accessory board is disposed adjacent and generally parallel to an adjacent one of said side faces.

11. A combination overhead support system and accessory board as set forth in claim 10, wherein:

said one hook is disposed on a first bracket having a plurality of like hooks arranged in a normally vertically aligned fashion; and said second hook is disposed on a second bracket having a plurality of like hooks arranged in a normally vertically aligned fashion.

12. A combination overhead support system and accessory board as set forth in claim 11, wherein:

said at least one side face of said accessory board includes a slatwall with horizontaly-extending channels to removably mount accessory units thereon.

13. A combination overhead support system and accessory board as set forth in claim 12, wherein:

said overhead support includes a plurality of said posts arranged in a horizontally-spaced about relationship.

14. A combination overhead support system and accessory board as set forth in claim 13, wherein:

said at least one beam extends between and is supported solely by two of said posts located adjacent opposite end portions of said beam.

15. A combination overhead support system and accessory board as set forth in claim 1, wherein:

said accessory board has an upper marginal edge normally disposed in a generally horizontal orientation a spaced-apart distance below said beam, and includes a bumper which selectively engages said at least one beam to facilitate retaining said accessory board in a predetermined position.

16. A combination overhead support system and accessory board as set forth in claim 15, wherein:

said bumper is disposed adjacent said second side edge of said accessory board to provide improved stability;

said bumper includes an upwardly opening U-shaped portion in which an adjacent lower portion of said at least one beam is received to positively prevent rotation of said accessory board about said first side edge; and said bumper is detachably fastened to said second side edge of said accessory board adjacent an upper portion thereof.

17. A combination overhead support system and accessory board as set forth in claim 1, wherein:

said at least one post includes a plurality of regularly spaced, vertically oriented slots defining said connector portion; and said accessory board includes at least one laterally-extending hook shaped for close reception in a selected one of said slots to detachably mount said accessory board on said at least one post.

18. A combination overhead support system and accessory board as set forth in claim 17, wherein:

said accessory board includes a second laterally-extending hook, spaced vertically apart from said one hook on said first side edge, and shaped for close reception in another one of said slots to securely, yet detachably support said accessory board on said at least one post in said cantilevered fashion.

19. A combination overhead support system and accessory board as set forth in claim 18, wherein:

said at least one post has a generally quadrilaterally-shaped horizontal cross-sectional configuration defining four side faces, and with a column of slots extending along each corner edge thereof; and said first side edge of said accessory board is disposed adjacent and generally parallel to an adjacent one of said side faces.

20. A combination overhead support system and accessory board, wherein:

said overhead support system includes at least one freestanding post and at least one beam;

said at least one freestanding post disposed in a substantially vertical position;

said at least one beam supported at least in part by said post in a substantially horizontal, overhead position;

said accessory board having opposite first and second marginal side edges normally disposed in a generally vertical orientation, wherein said first side edge is connected to said at least one post to support said accessory board on said at least one post in a cantilevered fashion; and a bumper connected with said accessory board and engaging a portion of said at least one beam to selectively retain said accessory board in a predetermined position.

21. A combination overhead support system and accessory board as set forth in claim 20, wherein:

said bumper is disposed adjacent said second side edge of said accessory board to provide improved stability.

22. A combination overhead support system and accessory board as set forth in claim 21, wherein:

said accessory board has an upper marginal edge normally disposed in a generally horizontal orientation a spaced-apart distance below said at least one beam; and said bumper is disposed adjacent said upper edge of said accessory board.

23. A combination overhead support system and accessory board as set forth in claim 22, wherein:

said bumper includes an upwardly opening U-shaped portion in which an adjacent lower portion of said at least one beam is received to positively prevent rotation of said accessory board about said first side edge.

24. A combination overhead support system and accessory board as set forth in claim 23, wherein:

said bumper is detachably fastened to said second side edge of said accessory board adjacent an upper portion thereof.

25. A combination overhead support system and accessory board as set forth in claim 24, wherein:

said at least one beam includes a pair of depending hanger channels disposed in a laterally spaced-apart relationship to define a space therebetween; and said bumper includes an upstanding center portion shaped for close reception in said space.

26. A combination overhead support system and accessory board as set forth in claim 25, wherein:

said bumper includes a pair of upstanding ears disposed adjacent opposite ends thereof shaped to abut exterior portions of said hanger channels to facilitate retaining said accessory board in said predetermined position.

27. A combination overhead support system and accessory board as set forth in claim 26, including:

a plurality of threaded fasteners detachably attaching said bumper to said accessory board.

28. A combination overhead support system and accessory board as set forth in claim 27, wherein:

said at least one post includes a plurality of regularly spaced, vertically oriented slots; and said accessory board includes at least one laterally-extending hook shaped for close reception in a selected one of said slots to detachably mount said accessory board on said at least one post.

29. A combination overhead support system and accessory board as set forth in claim 28, wherein:

said accessory board includes at least one side face defining a slatwall with horizontally-extending channels to removably mount accessory units thereon.

30. A combination overhead support and accessory system for workstations and the like, wherein:

said overhead support includes at least one freestanding post and at least one beam;

said at least one freestanding post disposed in a substantially vertical position and having a lower end adapted to support said at least one post on a floor;

said at least one beam supported at least in part by said post in a substantially horizontal, overhead position; said accessory system including:

a slatwall accessory board supported solely on said overhead support system, and having at least one side face thereof with a plurality of horizontally-extending channels spaced vertically apart along said at least one side face, said slatwall accessory board defining a lower edge spaced upwardly from said lower end of said at least one post to define a gap between said lower edge and the floor surface; and at least one accessory unit configured to personalize an associated workstation, and including a connector shaped for reception in said channels to detachably support said accessory unit at a plurality of locations on said at least one side face.

31. A combination overhead support and accessory system as set forth in claim 30, wherein:

said slatwall accessory board includes opposite first and second marginal side edges normally disposed in a generally vertical orientation, wherein said first side edge is detachably connected to said at least one post to support said accessory board on said at least one post in a cantilevered fashion.

32. A combination overhead support and accessory system as set forth in claim 31, wherein:

said slatwall accessory board has an upper marginal edge normally disposed in a generally horizontal orientation a spaced-apart distance below said at least one beam, and includes a bumper which selectively engages said at least one beam to facilitate retaining said accessory board in a predetermined position.

33. A combination overhead support and accessory system as set forth in claim 32, wherein:

said at least one post includes a plurality of regularly spaced, vertically oriented slots; and said slatwall accessory board includes at least one laterally-extending hook shaped for close reception in a selected one of said slots to detachably mount said slatwall accessory board on said at least one post.

34. A combination overhead support and accessory system as set forth in claim 33, wherein:

said slatwall accessory board includes a second laterally-extending hook, spaced vertically apart from said one hook on said first edge, and shaped for close reception in another one of said slots to securely, yet detachably support said slatwall accessory board on said post in said at least one cantilevered fashion.

35. A combination overhead support and accessory system as set forth in claim 34, wherein:

said at least one accessory unit comprises a paper management tray.

36. A combination overhead support system and accessory board, wherein:

said overhead support system includes at least one freestanding post and at least one beam;

said at least one freestanding post disposed in a substantially vertical position, and including at least one longitudinally-extending connector portion, said post defining a lower end adapted to support said post on a floor;

said at least one beam supported at least in part by said at least one post in a substantially horizontal overhead position; and said accessory board having at least one side face configured to removably support articles thereon, and opposite first and second marginal side edges normally disposed in a generally vertical orientation, wherein said first side edge is detachably connected to said connector portion of said at least one post to support said accessory board on said at least one post, with said second side edge being substantially free, and unconnected with said overhead support system, said accessory board defining a lower edge spaced upwardly from said lower end of said at least one post to define a gap between said lower edge and the floor surface.

* * * * *